US010699605B1

(12) United States Patent
Johnston et al.

(10) Patent No.: US 10,699,605 B1
(45) Date of Patent: Jun. 30, 2020

(54) MODULAR SPLIT AND/OR FLAP DISPLAYS AND ASSOCIATED INTERFACES AND COMMUNICATIONS

(71) Applicant: Vestaboard, Inc., Menlo Park, CA (US)

(72) Inventors: Andrew Johnston, Redwood City, CA (US); Faiza Hassan, Fairbanks, AK (US); Dorrian Porter, Menlo Park, CA (US); Ian Guyer, San Carlos, CA (US); Fred Bould, Menlo Park, CA (US); Kwan Hon Anson Cheung, San Francisco, CA (US); Brian Huppi, San Francisco, CA (US); Andrea Mucignat, San Francisco, CA (US)

(73) Assignee: Vestaboard, Inc., Menlo Park, CA (US)

( * ) Notice: Subject to any disclaimer, the term of this patent is extended or adjusted under 35 U.S.C. 154(b) by 0 days.

(21) Appl. No.: 16/248,332

(22) Filed: Jan. 15, 2019

Related U.S. Application Data

(60) Provisional application No. 62/618,025, filed on Jan. 16, 2018.

(51) Int. Cl.
*G09F 11/06* (2006.01)

(52) U.S. Cl.
CPC ..... *G09F 11/06* (2013.01)

(58) Field of Classification Search
USPC .... 40/500, 531, 533, 475, 462, 47; 340/317, 340/461; 368/26, 39, 78, 222
See application file for complete search history.

(56) References Cited

U.S. PATENT DOCUMENTS 3,402,490 A * 9/1968 Goldman ..... G09F 11/06 340/815.61
4,215,511 A * 8/1980 Todokoro ..... A63H 33/3027 40/475
7,372,179 B2 * 5/2008 Chiang ..... H02K 3/524 310/49.31
7,609,589 B1 * 10/2009 Sheu ..... G04C 17/0033 368/222

* cited by examiner

*Primary Examiner* — Cassandra Davis
(74) *Attorney, Agent, or Firm* — Amin, Turocy & Watson, LLP

(57) ABSTRACT

Methods, devices, and split flap wheel apparatuses that can display alphanumeric characters, messages, and graphics are provided. For example, one or more embodiments described herein can comprise a split flap wheel apparatus, comprising: a housing adapted to rotate about a center axis; flaps hingeably coupled, via hinges, to the housing that rotate externally to the housing with rotation of the housing; and a motor disposed within the housing that drives the rotation of the housing. One or more embodiments described herein can comprise a device comprising: a housing with at least one opening; a wheel within the housing; a group of hinged flaps affixed to an outside surface of the wheel along a circumference of the wheel; and a motor disposed within the wheel that operates to spin the wheel by the fixed amount of angular rotation.

20 Claims, 10 Drawing Sheets

MODULAR SPLIT AND/OR FLAP DISPLAYS AND ASSOCIATED INTERFACES AND COMMUNICATIONS

RELATED APPLICATION

The subject patent application claims priority to U.S. Provisional patent application No. 62/618,025, filed Jan. 16, 2018, and entitled "Modular Split and/or Flap Displays and Associated Interfaces and Communications," the entirety of which application is hereby incorporated by reference herein.

TECHNICAL FIELD

The subject application relates generally to the field of informational signage and displays. More specifically, various embodiments comprise a system of mechanical units or modules that work together to replace digital signage or traditional signage.

BACKGROUND

In 1902, the 'Plato Clock' was patented, which used two sets of plates that would rotate to display the time by changing the numbers displayed on the plates. Commonly today this is called a 'flip clock.' Later, in the 1940s and 1950s, split-flap displays, also called 'flap displays' were introduced as an electromechanical display device that presents changeable alphanumeric text, and occasionally fixed graphics.

These 'flap displays' were often used as public transport timetables in airports or railway stations, as such they are often called Solari boards after display manufacturer Solari di Udine from Udine, Italy, or, in Central European countries, Pragotron after the Czech manufacturer. Recently, companies have introduced similar devices to social media platforms such as Flapit.

Existing displays are limited by the type of and nature of content that can be displayed on the units because they are either designed to work as an entire static unit, or they have been limited by their capacity to transfer power and information, and particularly over distances.

SUMMARY

The following presents a summary to provide a basic understanding of one or more embodiments of the disclosure. This summary is not intended to identify key or critical elements, or to delineate any scope of particular embodiments or any scope of the claims. Its sole purpose is to present concepts in a simplified form as a prelude to the more detailed description that is presented later. In one or more embodiments described herein, methods, devices, and/or split flap wheel apparatuses that can display alphanumeric characters, messages, and graphics are described.

According to one or more example embodiments, a method is provided. The method includes: driving a motor located within a wheel of a housing of the split flap wheel module, resulting in a drive output; and, in response to the drive output of the motor, rotating the wheel about an axis according to a fixed angular increment, to move a first pair of split flaps of the split flap wheel module from being on display to a second pair of split flaps on display, wherein each of the split flaps comprise a top portion of an alphanumeric character, and a bottom portion of a different alphanumeric character, and wherein the motor is configured to rotate the wheel by the fixed angular increment to cause: a previously displayed top split flap of the first pair of split flaps, which displayed a top portion of a first alphanumeric character of the previously displayed top split flap, to rotate with the fixed angular increment to become a currently displayed bottom split flap, which displays a bottom portion of a second alphanumeric character different from the first alphanumeric character as a result of the previously displayed top split flap rotating to the currently displayed bottom split flap, a previously hidden from view split flap of the second pair of split flaps, hidden behind the previously displayed top split flap, to rotate with the fixed angular increment to become a currently displayed top split flap that displays a top portion of the second alphanumeric character, and a previously displayed bottom split flap to rotate with the fixed angular increment to make room for the currently displayed bottom split flap to display the bottom portion of the second alphanumeric character.

According to an embodiment, a device is provided. The device can include a housing with at least one opening; a wheel within the housing, wherein the wheel is configured to spin about an axis, and wherein the wheel comprises a group of inward-facing gear teeth; a group of hinged flaps affixed to an outside surface of the wheel along a circumference of the wheel, wherein each hinged flap of the group of hinged flaps comprises a top half alphanumeric character and a bottom half alphanumeric character on opposing sides of the hinged flap, wherein a first pair of hinged flaps of the group of hinged flaps are exposed via the at least one opening for external viewing, wherein the first pair of the hinged flaps respectively show a top half of a first alphanumeric character and a bottom half of the first alphanumeric character together showing the first alphanumeric character in full, wherein, when the wheel spins about the axis for a fixed amount of angular rotation, the first pair of the hinged flaps change to a second pair of hinged flaps of the group of hinged flaps, and wherein the second pair of the hinged flaps respectively show a top half of a second alphanumeric character different than the first alphanumeric character and a bottom half of the second alphanumeric character together showing the second alphanumeric character in full; and a motor disposed within the wheel that operates to spin the wheel by the fixed amount of angular rotation. In at least one embodiment, the motor of the device comprises a solenoid.

According to yet one or more example embodiments, a split flap wheel apparatus is provided. The split flap wheel apparatus can include a housing adapted to rotate about a center axis; flaps hingeably coupled, via hinges, to the housing that rotate externally to the housing with rotation of the housing; and a motor disposed within the housing that drives the rotation of the housing, wherein each of the flaps comprise a top portion of an alphanumeric character on a first side of the flap, and a bottom portion of a different alphanumeric character on a second side of the flap opposite the first side, wherein the motor is configured to cause a fixed amount of the rotation of the housing, and wherein the rotation by the fixed amount causes a previously displayed top split flap of the flaps, which displayed a top portion of a first alphanumeric character of the previously displayed top split flap, to rotate with the defined amount of the rotation of the housing to become a currently displayed bottom split flap, which displays a bottom portion of a second alphanumeric character different from the first alphanumeric character as a result of the previously displayed top split flap flipping to the currently displayed bottom split flap, wherein a previously hidden split flap, hidden behind the previously displayed top split flap, rotates with the defined amount of the rotation of the housing to become a currently displayed top split flap that displays a top portion of the second alphanumeric character, and wherein a previously displayed bottom split flap rotates with the defined amount of the rotation of the housing to yield space for the currently displayed bottom split flap to display the bottom portion of the second alphanumeric character.

The foregoing has outlined rather broadly the more pertinent and key features of the method, device, and split flap wheel apparatus herein so that the detailed description of the present application that follows may be better understood and so the method, device, and split flap wheel apparatus's present contribution to the art can be more fully appreciated. Additional features of the method, device, and split flap wheel apparatus will be described hereinafter. It should be appreciated by those skilled in the art that the disclosed specific method, device, and split flap wheel apparatus may be readily utilized as a basis for modifying or designing other structures for obtaining the same purposes of the method, device, and split flap wheel apparatus herein. It should be realized by those skilled in the art that such equivalent methods, devices, and split flap wheel apparatuses do not depart from the spirit and scope of the method, device, and split flap wheel apparatus herein.

In this respect, before explaining at least one embodiment of the method, device, and split flap wheel apparatus herein in detail, it is to be understood that the method, device, and split flap wheel apparatus are not limited in their application to details of construction and to arrangements of components set forth in the following description or illustrated in the drawings. The method, device, and split flap wheel apparatus are capable of other embodiments, and of being practiced and performed in various ways. Also, it is to be understood that phraseology and terminology employed herein are for a purpose of description and should not be regarded as limiting.

As such, those skilled in the art will appreciate that the conception, upon which this disclosure is based, may readily be utilized as a basis for designing of other structures, methods and systems for obtaining the several purposes of the method, device, and split flap wheel apparatus herein.

Figure 1:
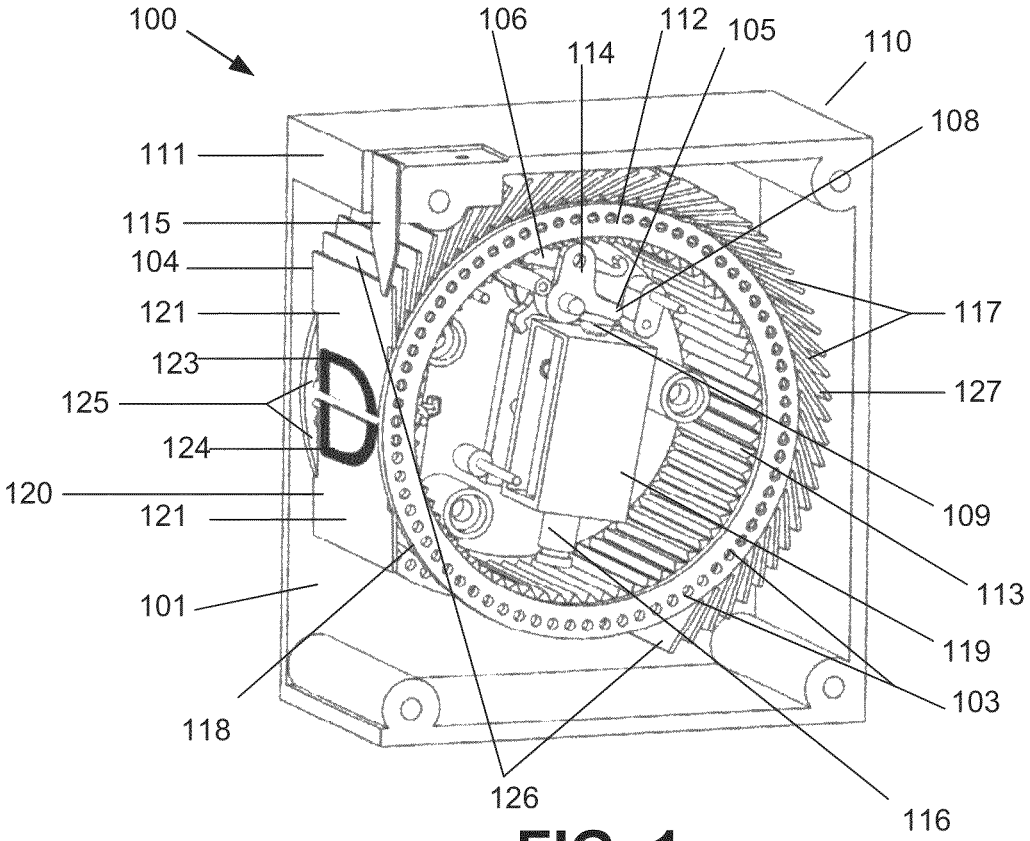
FIG. 1 illustrates a perspective view of the device, in accordance with disclosed embodiments.

The following detailed description is merely illustrative and is not intended to limit embodiments and/or application or uses of embodiments. Furthermore, there is no intention to be bound by any expressed or implied information presented in the preceding Background or Summary sections, or in the Detailed Description section.

One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident, however, in various cases, that the one or more embodiments can be practiced without these specific details.

As mentioned, various embodiments are described herein of a method, device, and split flap wheel apparatus that displays alphanumeric characters, messages, and/or graphics. As a system of units or modules, the display is more flexible to display and show a wide range of text, art, photographs, and other types of content, and be dynamically changed, as well as have modules added, subtracted or substituted. In addition, the size and use case for the display is made much more varied. By creating a modular system of interconnected units, each of which can be uniquely designed based on colors, size, text, and other shapes, and by connecting one or more of the units to sources of digital content, a greater range of displays can be created. For example, the split flap wheel apparatus can comprise a housing adapted to rotate about a center axis, flaps hingeably coupled to the housing that rotate externally to the housing with rotation of the housing, and a motor disposed within the housing that drives the rotation of the housing.

The device can comprise a housing with at least one opening; a wheel within the housing, wherein the wheel is configured to spin about an axis, and wherein the wheel comprises a group of inward-facing gear teeth; a group of hinged flaps affixed to an outside surface of the wheel along a circumference of the wheel, wherein each hinged flap of the group of hinged flaps comprises a top half alphanumeric character and a bottom half alphanumeric character on opposing sides of the hinged flap, wherein a first pair of hinged flaps of the group of hinged flaps are exposed via the at least one opening for external viewing, wherein the first pair of the hinged flaps respectively show a top half of a first alphanumeric character and a bottom half of the first alphanumeric character together showing the first alphanumeric character in full, wherein, when the wheel spins about the axis for a fixed amount of angular rotation, the first pair of the hinged flaps change to a second pair of hinged flaps of the group of hinged flaps, and wherein the second pair of the hinged flaps respectively show a top half of a second alphanumeric character different than the first alphanumeric character and a bottom half of the second alphanumeric character together showing the second alphanumeric character in full; and a motor disposed within the wheel that operates to spin the wheel by the fixed amount of angular rotation. In at least one embodiment, the motor of the device comprises a solenoid.

In this regard, and now referring to FIG. 1, a perspective view 100 of the device 110 is illustrated. In this example embodiment, the device 110 comprises: a housing 111 with an opening 101 on one side of the housing 112, a wheel 112 movably affixed inside the housing 111, wherein the wheel 112 is configured to rotate (rotation not pictured), and wherein the wheel 112 comprises a group of inward-facing gear teeth 113, a group of hinged flaps 117 affixed to the outside surface 118 of the wheel 112 via hinges 103, wherein the group of hinged flaps 117 comprises sets of hinged flaps 126 with a top half 121 and a bottom half 122, and the top half 121 of each individual hinged flap 127 contains the top half of an alphanumeric character 123 and a bottom half of a different alphanumeric character 124 on opposing sides of the hinged flap 127, wherein one set of hinged flaps 126 of the group of hinged flaps 117 is displayed 104 via the opening 101 of the housing 111, wherein the displayed set of hinged flaps 120 combines to form one completed alphanumeric character 125, wherein, when the wheel 112 rotates (rotation not pictured), the displayed set of the hinged flaps 120 changes to a different set of hinged flaps 126 of the group of hinged flaps 117, a motor 119 affixed inside the wheel 112 that operates to rotate (rotation not pictured) the wheel 112, wherein the motor 119 comprises at least two cylinders (not pictured) affixed to the inner surface of the wheel 112, at least two coils of wire (not pictured) wound around the at least two cylinders (not pictured), wherein the at least two coils of wire (not pictured) produce a magnetic field in response to an electric current applied to the at least two coils of wire (production of magnetic field and electric current not pictured), a stabilizer 115 movably affixed to the housing 111 that holds a top portion of the displayed set of hinged flaps 120 upright when the wheel 112 is stationary, and a ratchet 114 movably affixed to the inward-facing gears 113, wherein the ratchet 114 comprises a first distal end 105 and a second distal end 106, wherein the first distal end 106 of the ratchet 114 is configured to lockably engage (lockable engagement not pictured) with at least one inward-facing gear tooth 113, wherein the second distal end 106 comprises a flat surface 108, and wherein the ratchet 114 prevents the wheel 112 from rotating (rotation not pictured) when the first distal end 105 is lockably engaged (lockable engagement not pictured) with the inward-facing gear teeth 113, and a rod 116 movably affixed inside the wheel 112, wherein a distal end 109 of the rod 116 aligns with the flat surface 108 of the second distal end 106 of the ratchet 114, wherein the motor 119 causes the rod 116 aligned with the flat surface 108 of the second distal end 106 of the ratchet 114 to come into contact (contact not pictured) with the flat surface 108 causing the first distal end 105 of the ratchet 114 to disengage from the inward-facing gear teeth 113, allowing the wheel 112 to rotate (rotation not pictured).

Figure 2:
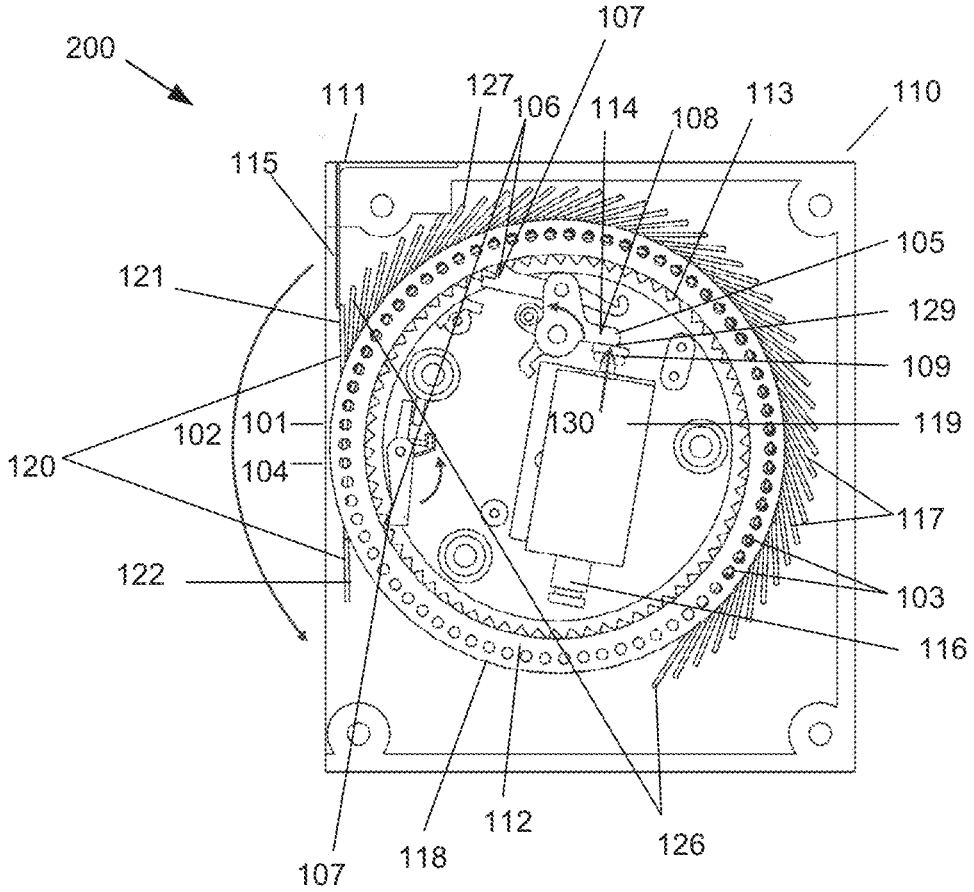
FIG. 2 illustrates a side view of the device, in accordance with disclosed embodiments.

Now referring to FIG. 2, a side view 200 of the device 110 is illustrated. In this example embodiment, the device 110 comprises: a housing 111 with an opening 101 on one side of the housing 112, a wheel 112 movably affixed inside the housing 111, wherein the wheel 112 is configured to rotate 102, and wherein the wheel 112 comprises a group of inward-facing gear teeth 113, a group of hinged flaps 117 affixed to the outside surface 118 of the wheel 112 via hinges 103, wherein the group of hinged flaps 117 comprises sets of hinged flaps 126 with a top half 121 and a bottom half 122, and the top half 121 of each individual hinged flap 127 contains the top half of an alphanumeric character (not pictured) and a bottom half of a different alphanumeric character (not pictured) on opposing sides of the hinged flap 127, wherein one set of hinged flaps 126 of the group of hinged flaps 117 is displayed 104 via the opening 101 of the housing 111, wherein the displayed set of hinged flaps 120 combines to form one completed alphanumeric character (not pictured), wherein, when the wheel 112 rotates 102, the displayed set of the hinged flaps 120 changes to a different set of hinged flaps 126 of the group of hinged flaps 117, a motor 119 affixed inside the wheel 112 that operates to rotate 102 the wheel 112, wherein the motor 119 comprises at least two cylinders (not pictured) affixed to the inner surface of the wheel 112, at least two coils of wire (not pictured) wound around the at least two cylinders (not pictured), wherein the at least two coils of wire (not pictured) produce a magnetic field in response to an electric current applied to the at least two coils of wire (production of magnetic field and electric current not pictured), and at least one voltage source component (not pictured) affixed to an inner surface of the wheel 112, a stabilizer 115 movably affixed to the housing 111 that holds a top portion of the displayed set of hinged flaps 120 upright when the wheel 112 is stationary, and a ratchet 114 movably affixed to the inward-facing gears 113, wherein the ratchet 114 comprises a first distal end 105 and a second distal end 106, wherein the first distal end 106 of the ratchet 114 is configured to lockably engage 107 with at least one inward-facing gear tooth 113, wherein the second distal end 106 comprises a flat surface 108, and wherein the ratchet 114 prevents the wheel 112 from rotating 102 when the first distal end 105 is lockably engaged 107 with the inward-facing gear teeth 113, and a rod 116 movably affixed inside the wheel 112, wherein a distal end 109 of the rod 116 aligns with the flat surface 108 of the second distal end 106 of the ratchet 114, wherein the motor 119 pushes or pulls 130 the rod 116 aligned with the flat surface 108 of the second distal end 106 of the ratchet 114 causing the rod 116 to come into contact 129 with the flat surface 108 causing the first distal end 105 of the ratchet 114 to disengage from the inward-facing gear teeth 113, allowing the wheel 112 to rotate 102.

Figure 3:
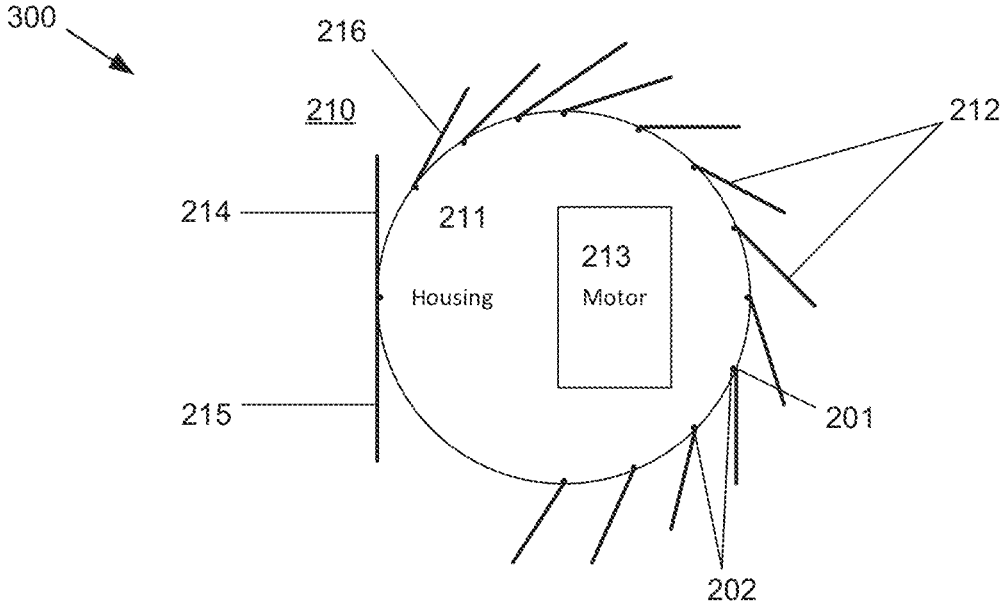
FIG. 3 illustrates a block diagram of the split flap wheel apparatus, in accordance with disclosed embodiments.

Now referring to FIG. 3, a block diagram 300 of the split flap wheel apparatus 210 is illustrated. In this example embodiment, the split flap wheel apparatus 210 comprises: a housing 211 adapted to rotate (rotation not pictured) about a center axis, flaps 212, hingeably coupled 201, via hinges 202, to the housing 211 that rotate (rotation not pictured) externally to the housing 211 with rotation (rotation not pictured) of the housing 211, and a motor 213 disposed within the housing 211 that drives the rotation (rotation not pictured) of the housing 211, wherein each of the flaps 212 comprise a top portion of an alphanumeric character (not pictured) on a first side of the flap (not pictured), and a bottom portion of a different alphanumeric character on a second side of the flap (not pictured) opposite the first side (not pictured), wherein the motor 213 is configured to cause a fixed amount of the rotation (rotation not pictured) of the housing 211, and wherein the rotation (rotation not pictured) by the fixed amount causes a previously displayed top split flap 216 of the flaps 112, which displayed a top portion of a first alphanumeric character (not pictured) of the previously displayed top split flap 216, to rotate (rotation not pictured) with the defined amount of the rotation (rotation not pictured) of the housing 211 to become a currently displayed bottom split flap 215, which displays a bottom portion of a second alphanumeric character (not pictured) different from the first alphanumeric character (not pictured) as a result of the previously displayed top split flap 216 flipping to the currently displayed bottom split flap 215, wherein a previously hidden split flap (not pictured), hidden behind the previously displayed top split flap 216, rotates (rotation not pictured) with the defined amount of the rotation (rotation not pictured) of the housing 211 to become a currently displayed top split flap 214 that displays a top portion of the second alphanumeric character (not pictured), and wherein a previously displayed bottom split flap (not pictured) rotates (rotation not pictured) with the defined amount of the rotation (rotation not pictured) of the housing 211 to yield space for the currently displayed bottom split flap 215 to display the bottom portion of the second alphanumeric character (not pictured).

Figure 4:
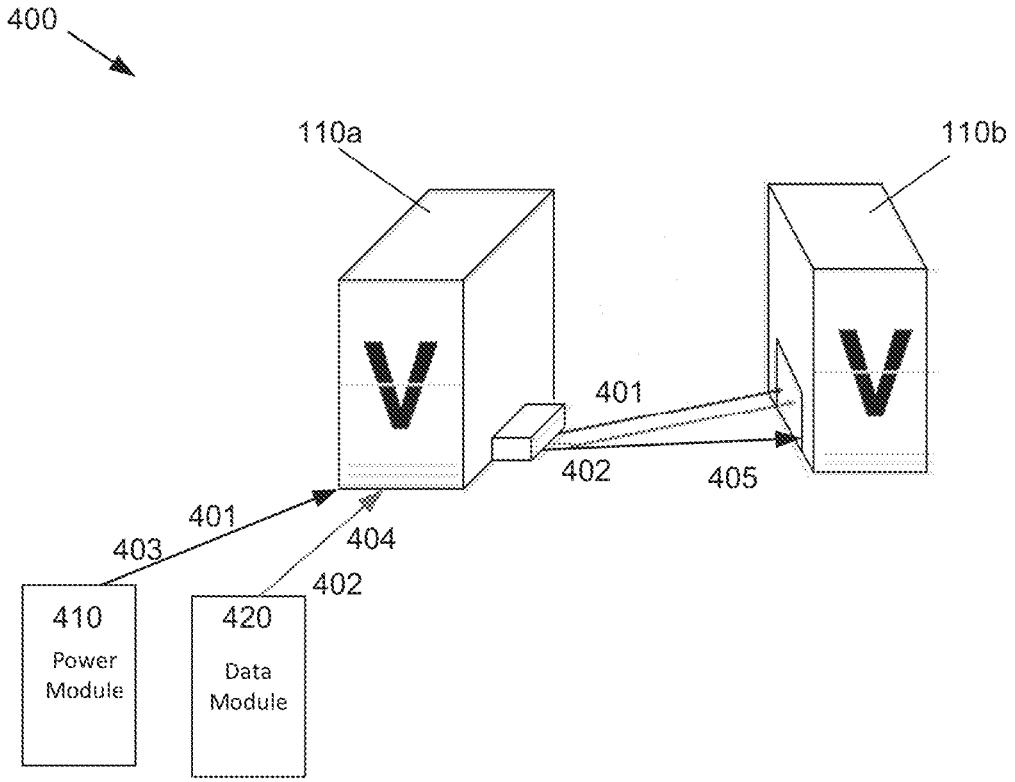
FIG. 4 illustrates a block diagram of an example implementation of the device, in accordance with disclosed embodiments.

Now referring to FIG. 4, a block diagram of an example implementation 400 of the device 110 is illustrated. In FIG. 4, the implementation 400 of the device 110 comprises the transfer of power 401 from a power module 410 to a device 110*a* via a physical connection 403 and/or the transfer of data 402 from a data module 420 to the device 110*a* via a physical connection 404, wherein the module to receive data 420 receives data from the cloud or other computer, and wherein the power and/or data is transferred from the device 110*a* to a device 110*b* via a physical connection 405. Alternatively, in another embodiment, the implementation 400 can be an implementation of at least one split flap wheel apparatus 210. In another embodiment, the implementation 400 can be an implementation of at least one split flap wheel apparatus 210 and at least one device 110. It should be noted that the physical connection 405 between device 110*a* and device 110*b* depicted in FIG. 4 is just one of several possible locations for a physical connection between the devices. In other embodiments the physical connection 405 can be located on the back panels of device 110*a* and device 110*b*. In yet another embodiment, the physical connection 405 between device 110*a* and device 110*b* can be facilitated by a connection to another object (such as a plate).

Figure 5:
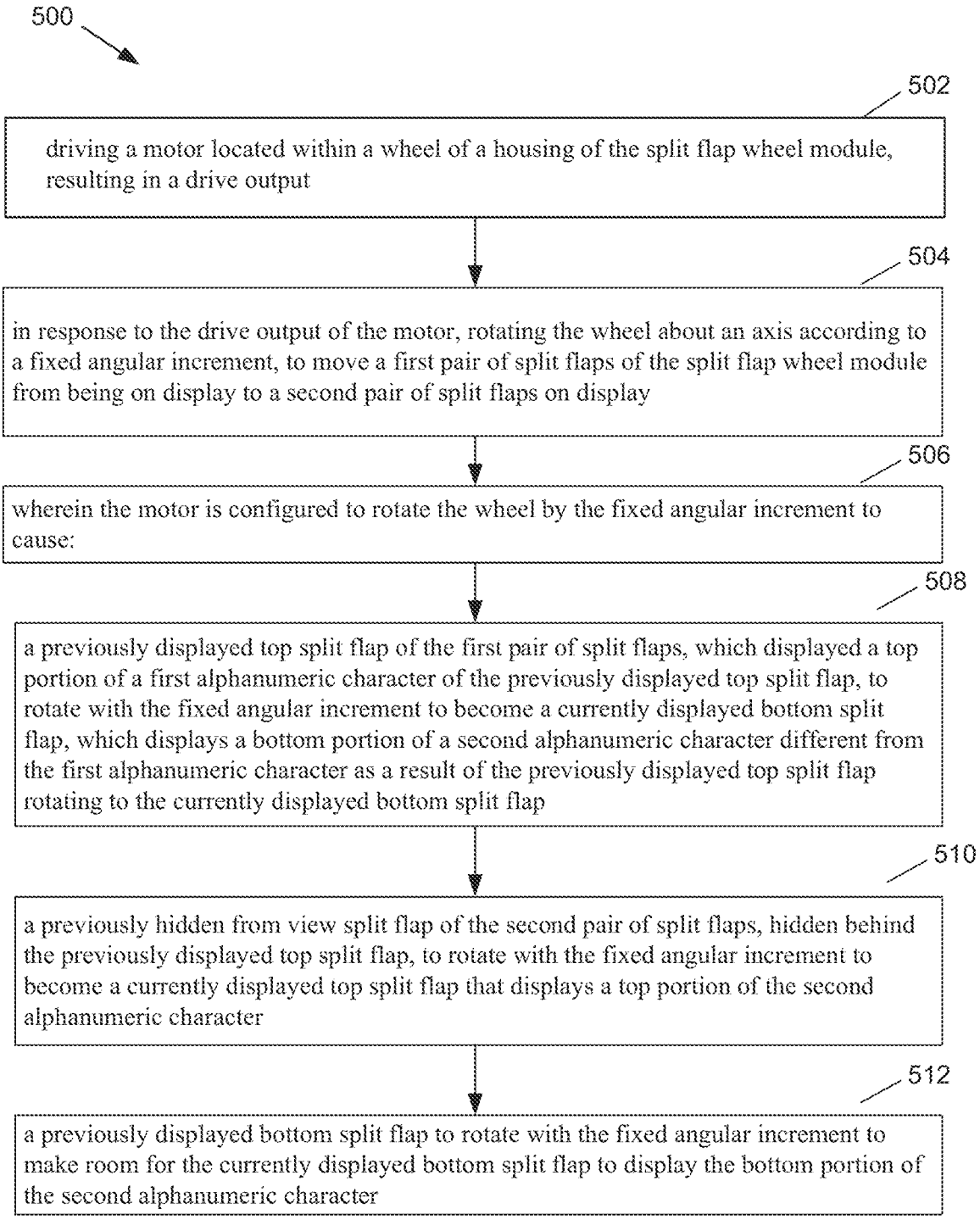
FIG. 5 illustrates a flowchart of an example method of operating a split flap wheel module, in accordance with disclosed embodiments.

Now referring to FIG. 5, a flowchart 500 of a method of operating a split flap wheel module is illustrated. The method comprising: 502 driving a motor located within a wheel of a housing of the split flap wheel module, resulting in a drive output, 504 in response to the drive output of the motor, rotating the wheel about an axis according to a fixed angular increment, to move a first pair of split flaps of the split flap wheel module from being on display to a second pair of split flaps on display, 506 wherein the motor is configured to rotate the wheel by the fixed angular increment to cause: 508 a previously displayed top split flap of the first pair of split flaps, which displayed a top portion of a first alphanumeric character of the previously displayed top split flap, to rotate with the fixed angular increment to become a currently displayed bottom split flap, which displays a bottom portion of a second alphanumeric character different from the first alphanumeric character as a result of the previously displayed top split flap rotating to the currently displayed bottom split flap, 510 a previously hidden from view split flap of the second pair of split flaps, hidden behind the previously displayed top split flap, to rotate with the fixed angular increment to become a currently displayed top split flap that displays a top portion of the second alphanumeric character, and 512 a previously displayed bottom split flap to rotate with the fixed angular increment to make room for the currently displayed bottom split flap to display the bottom portion of the second alphanumeric character.

Figure 6:
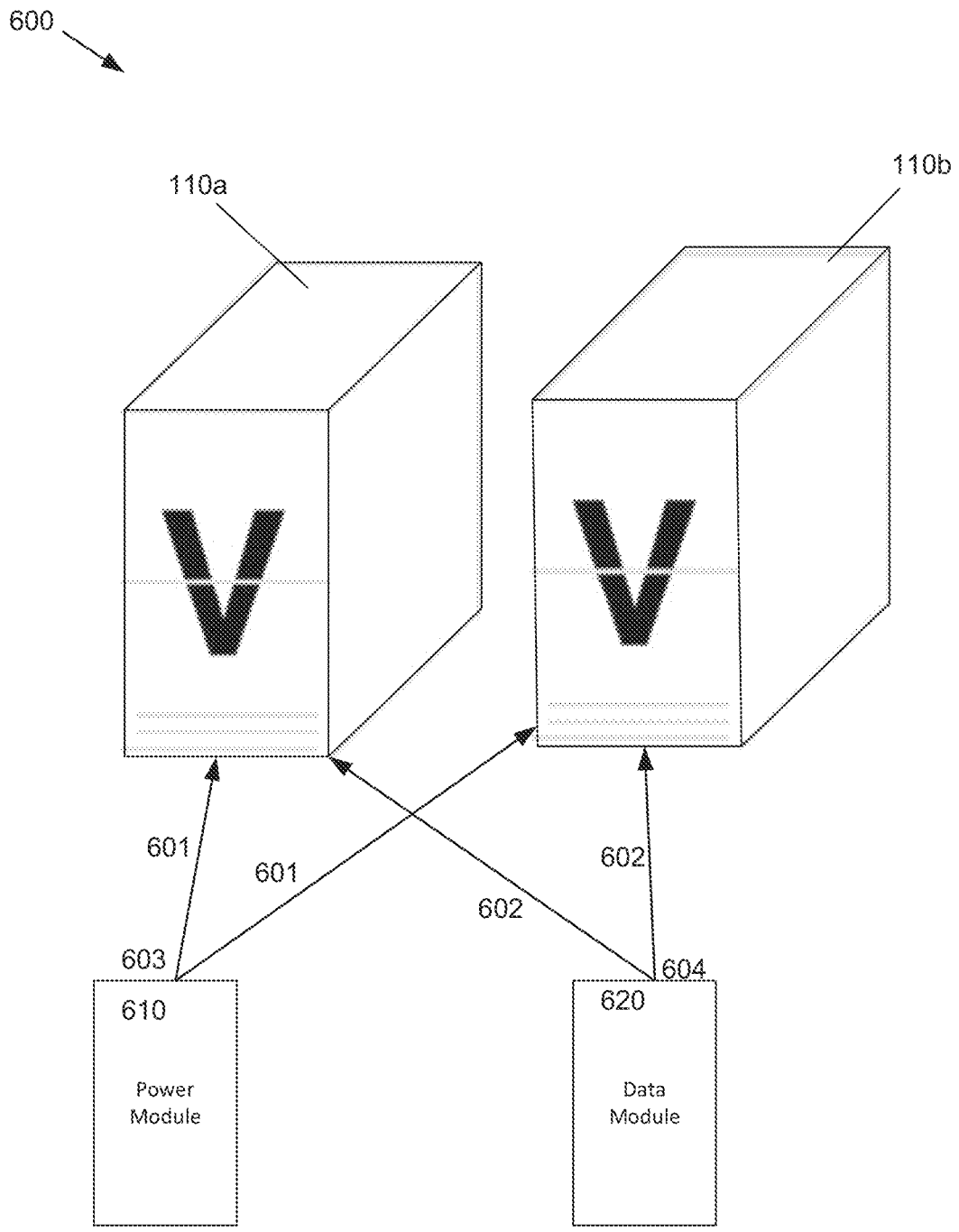
FIG. 6 illustrates a illustrates a block diagram of an example implementation of the split flap wheel apparatus, in accordance with disclosed embodiments.

Now referring to FIG. 6, a block diagram of an example implementation 600 of the device 110 is illustrated. In FIG. 6, the implementation 600 of the device 110 comprises the wireless transfer of power 601 from a module for wireless power 610 to a device 110*a* and device 110*b* via a wireless connection 603 and/or the wireless transfer of data 602 from a module to receive and send wireless data 620 to the device 110*a* and device 110*b* via a wireless connection 604, wherein the module to receive and send wireless data 620 receives data from the cloud or other computer. Alternatively, in another embodiment, the implementation 600 can be an implementation of at least one split flap wheel apparatus 210. In another embodiment, the implementation 600 can be an implementation of at least one split flap wheel apparatus 210 and at least one device 110.

Figure 7:
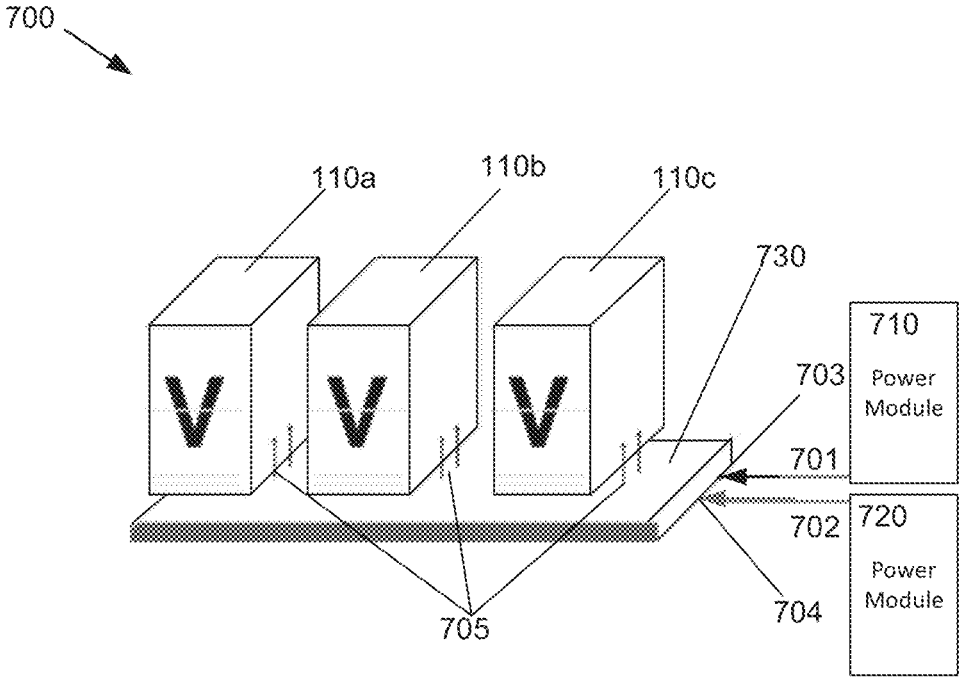
FIG. 7 illustrates a illustrates a block diagram of an example implementation of the split flap wheel apparatus, in accordance with disclosed embodiments.

Now referring to FIG. 7, a block diagram of an example implementation 700 of the device 110 is illustrated. In FIG. 7, the implementation 700 of the device 110 comprises the transfer of power 701 from a power module 710 to a plate 730 via a physical connection 703 and/or the transfer of data 702 from a data module 720 to the plate 730 via a physical connection 704, wherein the module to receive data 720 receives data from the cloud or other computer, and wherein the power and/or data is transferred from the plate 730 to a device 110*a*, a device 110*b*, and a device 110*c* via a physical connection 705. Alternatively, in another embodiment, the implementation 700 can be an implementation of at least one split flap wheel apparatus 210. In another embodiment, the implementation 700 can be an implementation of at least one split flap wheel apparatus 210 and at least one device 110.

Figure 8:
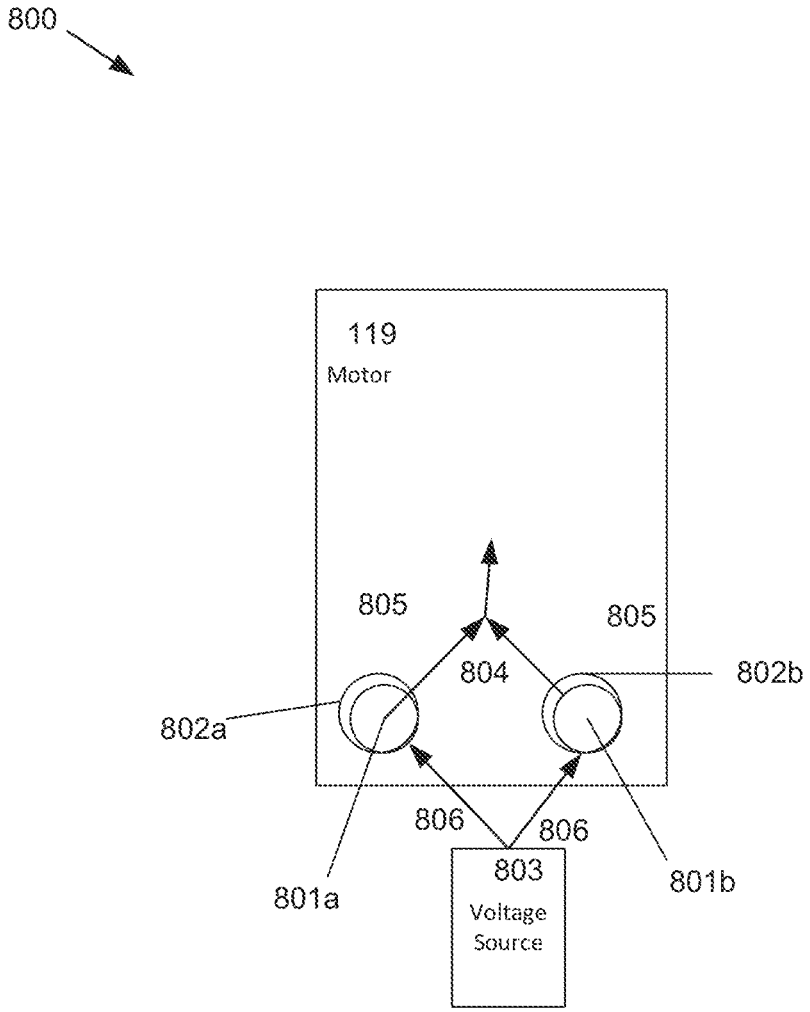
FIG. 8 illustrates a block diagram of the motor of the device, in accordance with disclosed embodiments.

Now referring to FIG. 8, a block diagram 800 of the motor 119 of the device 110 is illustrated. In this example embodiment, the motor 119 comprises: at least two cylinders (801*a* and 801*b*), at least two coils of wire (802*a* and 802*b*) wound around the at least two cylinders (801*a* and 801*b*), and at least one voltage source 803, wherein the at least two coils of wire (802*a* and 802*b*) produce a magnetic field 804 in response to an electric current 805 applied to the at least two coils of wire (802*a* and 802*b*), wherein the at least one voltage source 803 applies a voltage 806 across the at least two coils of wire (802*a* and 802*b*), wherein the voltage 806 generates the electric current 805 through the at least two coils of wire (802*a* and 802*b*) which produces the magnetic field 804 that facilitates driving of the motor 119.

Figure 9:
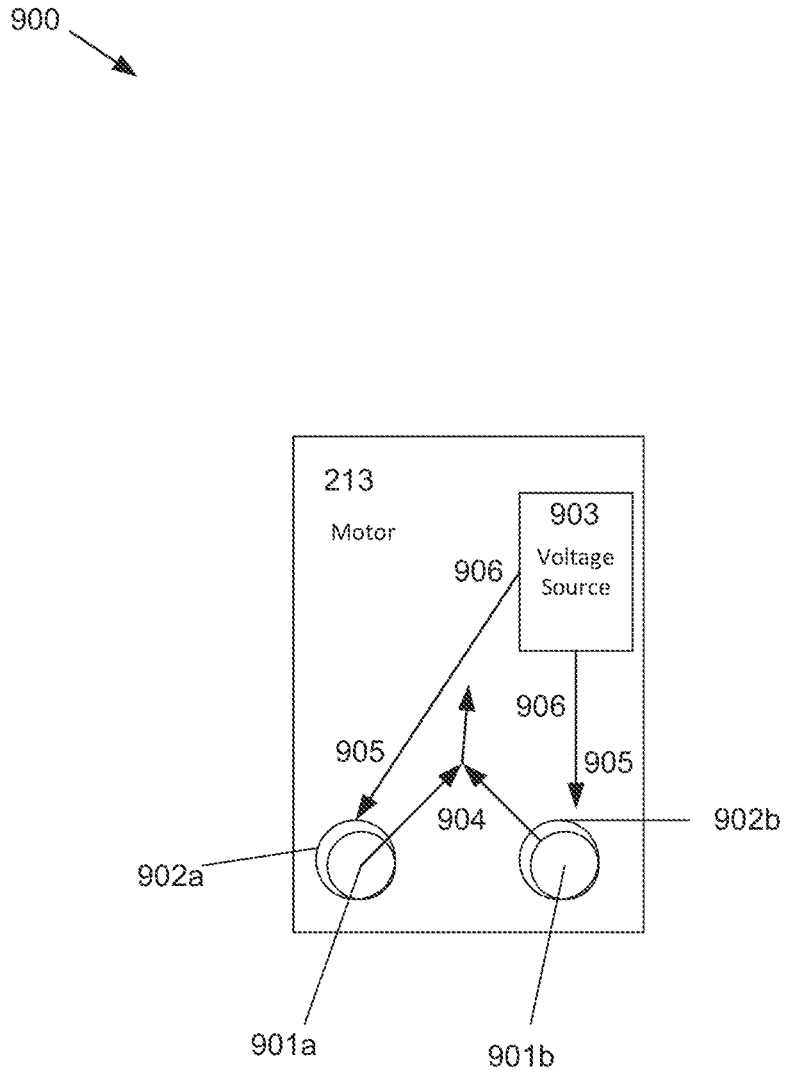
FIG. 9 illustrates a block diagram of the motor of the split flap wheel apparatus, in accordance with disclosed embodiments.

Now referring to FIG. 9, a block diagram 900 of the motor 213 of the split flap wheel apparatus 210 is illustrated. In this example embodiment, the motor 213 comprises: at least two cylinders (901*a* and 901*b*), at least two coils of wire (902*a* and 902*b*) wound around the at least two cylinders (901*a* and 901*b*), and at least one voltage source 903, wherein the at least two coils of wire (902*a* and 902*b*) produce a magnetic field 904 in response to an electric current 905 applied to the at least two coils of wire (902*a* and 902*b*), wherein the at least one voltage source 903 applies a voltage 906 across the at least two coils of wire (902*a* and 902*b*), wherein the voltage 906 generates the electric current 905 through the at least two coils of wire (902*a* and 902*b*) which produces the magnetic field 904 that facilitates driving of the motor 213.

Figure 10:
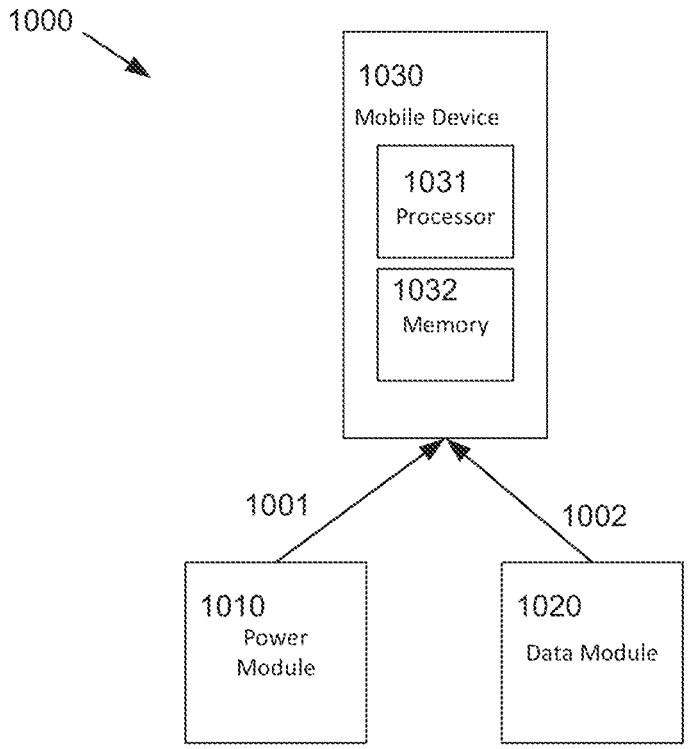
FIG. 10 illustrates a block diagram of an example computer implementation 1000 of the method of operating the split flap wheel module, in accordance with disclosed embodiments.

Now referring to FIG. 10, a block diagram of an example computer implementation 1000 of the method of operating the split flap wheel module 210 is illustrated. In FIG. 10, the computer implementation 1000 of the method of operating the split flap wheel module 210 comprises the transfer of power 1001 from a power module 1010 to a mobile device 1030 (such as a smart phone or a tablet computer) and/or the transfer of data 1002 from a data module 1020 to the mobile device, wherein the data module 1020 receives data from the cloud or other computer, wherein the mobile device 1030 comprises a processor 1031, operably coupled to a memory 1032, that can execute computer executable instructions comprising: driving a motor located within a wheel of a housing of the split flap wheel module, resulting in a drive output (not pictured), in response to the drive output of the motor, rotating the wheel about an axis according to a fixed angular increment, to move a first pair of split flaps of the split flap wheel module from being on display to a second pair of split flaps on display (not pictured), wherein the motor is configured to rotate the wheel by the fixed angular increment to cause: a previously displayed top split flap of the first pair of split flaps, which displayed a top portion of a first alphanumeric character of the previously displayed top split flap, to rotate with the fixed angular increment to become a currently displayed bottom split flap, which displays a bottom portion of a second alphanumeric character different from the first alphanumeric character as a result of the previously displayed top split flap rotating to the currently displayed bottom split flap (not pictured), a previously hidden from view split flap of the second pair of split flaps, hidden behind the previously displayed top split flap, to rotate with the fixed angular increment to become a currently displayed top split flap that displays a top portion of the second alphanumeric character (not pictured), and a previously displayed bottom split flap to rotate with the fixed angular increment to make room for the currently displayed bottom split flap to display the bottom portion of the second alphanumeric character (not pictured), and wherein the mobile device 1030 can execute the computer instructions in any of implementation 300, implementation 500, or implementation 600 discussed above.

Those skilled in the art will recognize that, unless specifically indicated or required by the sequence of operations, certain steps in the processes described above may be omitted, performed concurrently or sequentially, or performed in a different order.

Although an exemplary embodiment of the present disclosure has been described in detail, those skilled in the art will understand that various changes, substitutions, variations, and improvements disclosed herein may be made without departing from the spirit and scope of the disclosure in its broadest form.

Aspects of the present application are described herein with reference to flowchart illustrations and/or block diagrams of methods, apparatuses, and devices according to embodiments of the present application. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of methods, apparatuses, and devices according to various embodiments in the present application. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A split flap wheel apparatus, comprising:

a housing adapted to rotate about a center axis;

flaps hingeably coupled, via hinges, to the housing that rotate externally to the housing with rotation of the housing; and a motor disposed within the housing that drives the rotation of the housing, the motor comprising at least two cylinders affixed to an inner surface of the housing, wherein each of the flaps comprise a top portion of an alphanumeric character on a first side of the flap, and a bottom portion of a different alphanumeric character on a second side of the flap opposite the first side, wherein the motor is configured to cause a fixed amount of the rotation of the housing, and wherein the rotation by the fixed amount causes a previously displayed top split flap of the flaps, which displayed a top portion of a first alphanumeric character of the previously displayed top split flap, to rotate with the defined amount of the rotation of the housing to become a currently displayed bottom split flap, which displays a bottom portion of a second alphanumeric character different from the first alphanumeric character as a result of the previously displayed top split flap flipping to the currently displayed bottom split flap, wherein a previously hidden split flap, hidden behind the previously displayed top split flap, rotates with the defined amount of the rotation of the housing to become a currently displayed top split flap that displays a top portion of the second alphanumeric character, and wherein a previously displayed bottom split flap rotates with the defined amount of the rotation of the housing to yield space for the currently displayed bottom split flap to display the bottom portion of the second alphanumeric character.

2. The apparatus of claim 1, wherein the rotation is a defined amount of angular rotation about the center axis.

3. The apparatus of claim 1, wherein the housing comprises a cylindrical cross section or a polygonal cross section.

4. The apparatus of claim 1, wherein the motor is a stepper motor that causes the rotation by the fixed amount.

5. The apparatus of claim 1, wherein the flaps are polygonal.

6. The apparatus of claim 1, wherein the flaps are rectangular.

7. The apparatus of claim 1, wherein the hinges on the flaps are located on outer edges of respective portions of the flaps that display the alphanumeric character.

8. The apparatus of claim 1, wherein the hinges on the flaps are located on respective bottom edges of respective portions of the flaps that display the alphanumeric character, and wherein the bottom edges are nearest to the surface of the housing relative to other edges of the flaps.

9. A device, comprising:

a housing with at least one opening;

a wheel within the housing, wherein the wheel is configured to spin about an axis;

a group of hinged flaps affixed to an outside surface of the wheel along a circumference of the wheel, wherein each hinged flap of the group of hinged flaps comprises a top half alphanumeric character and a bottom half alphanumeric character on opposing sides of the hinged flap, wherein a first pair of hinged flaps of the group of hinged flaps are exposed via the at least one opening for external viewing, wherein the first pair of the hinged flaps respectively show a top half of a first alphanumeric character and a bottom half of the first alphanumeric character together showing the first alphanumeric character in full, wherein, when the wheel spins about the axis for a fixed amount of angular rotation, the first pair of the hinged flaps change to a second pair of hinged flaps of the group of hinged flaps, and wherein the second pair of the hinged flaps respectively show a top half of a second alphanumeric character different than the first alphanumeric character and a bottom half of the second alphanumeric character together showing the second alphanumeric character in full; and a motor disposed within the wheel that operates to spin the wheel by the fixed amount of angular rotation, the motor comprising at least two cylinders affixed to an inner surface of the wheel.

10. The device of claim 9, wherein the motor comprises a solenoid that causes the rotation by the fixed amount.

11. The device of claim 9, further comprising:

a stabilizer movably affixed to the housing that holds a top portion of a hinged flap, which is on display to a viewer, upright when the wheel is not rotating.

12. The device of claim 9, wherein the wheel comprises a group of inward-facing gear teeth, and further comprising:

at least one ratchet movably affixed to at least one inward-facing gear tooth of the group of inward-facing gear teeth of the wheel, wherein the at least one ratchet comprises a first distal end and a second distal end, wherein the first distal end of the at least one ratchet is configured to lockably engage with the at least one inward-facing gear tooth, wherein the second distal end comprises a flat surface, and wherein the at least one ratchet prevents the wheel from rotating when the first distal end is lockably engaged with the at least one inward-facing gear tooth, thereby affixing a position of the at least one ratchet until the first distal end disengages from the at least one inward-facing gear tooth.

13. The device of claim 9, further comprising:

at least two coils of wire wound around the at least two cylinders, wherein the at least two coils of wire produce a magnetic field in response to an electric current applied to the at least two coils of wire, and wherein the magnetic field produced by the at least two coils of wire facilitates driving of a solenoid between locked positions to advance the wheel to display a next alphanumeric character after a currently displayed alphanumeric character.

14. The device of claim 9, further comprising:

at least two coils of wire; and at least one voltage source component affixed to an inner surface of the wheel, wherein the at least one voltage source applies a voltage across the at least two coils of wire, wherein the voltage generates an electric current through the at least two coils of wire that produces a magnetic field that facilitates driving of the motor, and wherein activation of the voltage source component is controlled by at least one of another device, a wireless controller, or a circuit board to which the housing unit is attached.

15. The device of claim 14, wherein the wheel comprises a group of inward-facing gear teeth, and further comprising:

at least one ratchet movably affixed to at least one inward-facing gear tooth of the group of inward-facing gear teeth of the wheel, wherein the at least one ratchet comprises a first distal end and a second distal end; and at least one rod movably affixed to an inner surface of the wheel, wherein a distal end of the at least one rod aligns with a flat surface distal end of the at least one ratchet, wherein a magnetic field generated by a current applied to the at least two coils of wire pushes or pulls the at least one rod, to lock or unlock a movement of the motor, respectively.

16. A method of operating a split flap wheel module, comprising:

driving a motor located within a wheel of a housing of the split flap wheel module, resulting in a drive output, the motor comprising at least two cylinders affixed to an inner surface of the wheel; and in response to the drive output of the motor, rotating the wheel about an axis according to a fixed angular increment, to move a first pair of split flaps of the split flap wheel module from being on display to a second pair of split flaps on display, wherein each of the split flaps comprise a top portion of an alphanumeric character, and a bottom portion of a different alphanumeric character, and wherein the motor is configured to rotate the wheel by the fixed angular increment to cause:

a previously displayed top split flap of the first pair of split flaps, which displayed a top portion of a first alphanumeric character of the previously displayed top split flap, to rotate with the fixed angular increment to become a currently displayed bottom split flap, which displays a bottom portion of a second alphanumeric character different from the first alphanumeric character as a result of the previously displayed top split flap rotating to the currently displayed bottom split flap, a previously hidden from view split flap of the second pair of split flaps, hidden behind the previously displayed top split flap, to rotate with the fixed angular increment to become a currently displayed top split flap that displays a top portion of the second alphanumeric character, and a previously displayed bottom split flap to rotate with the fixed angular increment to make room for the currently displayed bottom split flap to display the bottom portion of the second alphanumeric character.

17. The method of claim 16, further comprising:

using the drive output of the motor, rotating the wheel about the axis according to the fixed angular increment, to move the second pair of split flaps of the split flap wheel module from being on display to a third pair of split flaps on display.

18. The method of claim 16, further comprising:

using the drive output of the motor to move at least one rod movably affixed to an inside of the wheel according to the fixed angular increment, as a result of which the at least one rod is pulled to unlock rotation of the wheel and then pushed to relock the rotation of the wheel to display a next alphanumeric character.

19. The method of claim 16, wherein the housing of the split flap wheel module is a first housing of a first split flap wheel module, wherein the first split flap wheel module is configured to electrically and mechanically couple to at least one other split flap wheel module, and wherein the first split flap wheel module cooperates with the at least one other split flap wheel module to display multiple alphanumeric characters.

20. The method of claim 16, wherein the motor is a stepper motor.

* * * * *